US006315885B1

(12) United States Patent
Hocheng

(10) Patent No.: US 6,315,885 B1
(45) Date of Patent: Nov. 13, 2001

(54) METHOD AND APPARATUS FOR ELECTROPOLISHING AIDED BY ULTRASONIC ENERGY MEANS

(75) Inventor: Hong Hocheng, Hsinchu (TW)

(73) Assignee: National Science Council, Taipei (TW)

( * ) Notice: Subject to any disclaimer, the term of this patent is extended or adjusted under 35 U.S.C. 154(b) by 0 days.

(21) Appl. No.: 09/428,605

(22) Filed: Oct. 27, 1999

(30) Foreign Application Priority Data

Sep. 7, 1999 (TW) ..... 088115388

(51) Int. Cl.[7] ..... C25F 3/16; C25D 17/00; C25B 9/00

(52) U.S. Cl. ..... 205/652; 205/660; 205/671; 205/685; 204/224 M; 204/240; 204/273; 204/275.1

(58) Field of Search ..... 204/224 M, 275.1, 204/240, 273; 205/640, 660, 652, 671, 685

(56) References Cited

U.S. PATENT DOCUMENTS 4,414,244 * 11/1983 Timberlake et al. ..... 205/661 X 5,378,331 * 1/1995 Kemp ..... 205/671

* cited by examiner

*Primary Examiner*—Donald R. Valentine

(57) ABSTRACT

The present invention relates to a method of electropolishing aided by ultrasonic means having the capability of rapidly discharging dregs. More specifically, the invention relates to a method of electrochemical polishing process aided by an auxiliary ultrasonic cleaning device which emits ultrasonic vibrating energy to effectively discharge dregs, shorten the polishing cycle time for each workpiece, and improve the surface roughness of the workpiece. The present invention further provides an electropolishing apparatus that can be easily retrofitted to almost every existing machine tool as an auxiliary unit. Alternately, the ultrasonic apparatus can be installed separately as an independent ultrasonic generating unit. Metal workpieces are then immersed in an electrolyte solution excited by high-frequency ultrasonic energy in order to have the dregs and other electropolishing byproducts rapidly discharged and removed from working area, so surface roughness of processed workpieces can be rapidly improved with a simple, low-cost ultrasonic apparatus.

16 Claims, 3 Drawing Sheets

METHOD AND APPARATUS FOR ELECTROPOLISHING AIDED BY ULTRASONIC ENERGY MEANS

BACKGROUND OF THE INVENTION

1. Field of the Invention

The present invention relates to a method of electropolishing aided by ultrasonic means having the capability of rapidly discharging dregs. More specifically, the invention relates to a method of electrochemical polishing aided by an auxiliary ultrasonic apparatus which emits ultrasonic vibrating energy to effectively discharge dregs, shorten the polishing cycle time for each workpiece, and improve the surface roughness of the workpiece.

2. Description of Related Art

The current electropolishing process was ushered in at the dawn of modern electronic technology by Michael Faraday of the $18^{th}$ century, who performed a series of brilliant experiments on the fundamental properties of electricity. The electrochemical polishing process, or electropolishing, utilizes a combination of electrical and chemical energy that would systematically remove a thin layer of surface material from a workpiece in order to polish the workpiece surface to a certain required surface roughness Ra. During an electropolishing process, a metallic workpiece is immersed in an electrolyte, which fills in the gap between the workpiece and the tool electrode. The tool electrode is connected with a cathode of a DC power source while the workpiece is connected with an anode of the source. In general, the rate of electrochemical-erosion, induced by the combined electrical and chemical energy, is basically determined by accessibility of the electrolyte to various topographical features of a workpiece surface. For example, a fairly rough surface area of a metal workpiece would constitute some micro-peaks where ions have easier access and some micro-troughs and micro-pores on the surface where less reaction can take place due to difficulty in access. Such electrochemical polishing, or electropolishing, method can usually overcome the difficulties in processing stainless steel or any other hardened steel materials of extreme hardness by conventional methods. Further, the electropolishing process is applicable to metal workpieces requiring further polishing after conventional or non-conventional machining steps, such as those of milling and electro-erosion, respectively. Specifically, the electropolishing process can replace conventional manual and mechanical polishing and deburring methods, where results are usually restricted by the skill and experience of the operating personnel; moreover, the cost of manual operation is almost always higher than an operation that can be automated by mechanical devices. Furthermore, the uneven contacting surface pressure of either an manual or a mechanical polishing method often causes under- or over-polishing of the workpiece, and a residual stress is hence created locally on the surface of the workpiece. Such residual stress sometimes exceeds the limit which the surface strength of subject steel workpiece is capable of withstanding and results in a surface collapsing. Large numbers of surface micro-pores are then scattered all over the surface causing a shortened expected operating life of a finished workpiece. Besides, training of qualified operating personnel in manual polishing is proving to be more and more difficult; further, mechanical polishing is sometimes limited by the geometrical shape and material characteristics of the workpieces. Therefore, electrochemical polishing, or electropolishing, can indeed improve drawbacks of polishing technique in the industry and can elevate the quality of traditional polishing.

Currently, electropolishing process has been applied on, for the most part, surface polishing of stainless steel materials. The electrochemical polishing process is usually performed on workpieces right after conventional or non-conventional machining steps such as those of milling and electro-erosion for opening up concavities, ridding surface reaction byproducts, providing erosion-resistance on processed surface area, and polishing the workpiece to a required surface roughness. The result is a chemical removal over the entire surface, but more accentuated in the ridges than in the troughs and resulting in a substantially smoother surface, and eliminating the micro-tearing and grooving which results from mechanical polishing techniques. Nevertheless, the conventional electropolishing requires the workpieces or metal parts to be completely secured and immersed in an electrolyte solution for an extended period of time for polishing, during which the workpiece is usually not actively cleaned and polished by any tool electrode or third-party polishing aid. The drawbacks of conventional electropolishing process are then lacking of active polishing aid, long polishing cycle time, and minimum material removal rate, whereby the conventional electropolishing process is basically limited to application in stainless steel polishing.

An alternative method for the conventional electropolishing method is an electropolishing using pulsing DC source to accomplish a rapid improvement of the surface roughness of the workpiece. Pulsing DC source employs a lower average electric current density without having to operate with high electrode flow rate as it is required by the conventional electropolishing method. This is because the heat and reaction byproducts are purged at each off-peak interval of the electric pulse. However, the non-conventional DC pulsing electropolishing method is limited in application in that the required polishing time is extended due to off-peak intervals during the pulsing process and in that the material removal rate is relatively small.

Furthermore, still another alternative to conventional electropolishing is an ultrasonic-aided machining process introduced since 1927, which has been playing an important role in the machining industry since. Currently, ultrasonic machining is applied in the fields of material science, mechanical and electric engineering's, chemistry, and even medical science. Ultrasonic energy is a high-frequency vibrating electric or magnetic energy generated by an ultrasonic oscillator, which in turn transforms a high-frequency electric energy into a high-frequency mechanic energy by means of electric or magnetic field change. Moreover, ultrasonic machining, or USM, operates in a liquid mixture of water and abrasive medium, or slurry, wherein an oscillation amplitude of 10~15 $\mu$m and a high frequency of 15~30 kHz are preferably selected in order to rapidly clean and fine-polish the surface of the workpiece by means of a vibrating slurry.

SUMMARY OF THE INVENTION

Accordingly, it is an object of the present invention to provide a method of electropolishing aided by ultrasonic means which is easy to operate, easy to be retrofitted to an existing electric discharge machining tool, low in overall cost, low in environmental pollution, and conveniently applicable to various geometrical forms of tool electrodes. In order to fulfill the object of the present invention, the method according to the present invention can install a DC power source to an existing machine tool with ease; in addition, an ultrasonic cleaning device and an electrolyte supplying unit are all installed to the existing machine tool as one complete auxiliary ultrasonic apparatus. The positive terminal of a DC source is connected to a workpiece to be polished, and a certain gap exists in between the positively connected workpiece and the negatively connected tool electrode during the said electrochemical polishing process. During an electropolishing process, high-frequency vibrating ultrasonic energy is to be provided directly to the electrolyte solution to assist the electropolishing process throughout the entire course, effectively preventing reaction byproducts from attaching to the electrode. In particular, the metal workpiece immersed in the electrolyte excited by high-frequency ultrasonic energy has the advantages of having the dregs and other electropolishing byproducts rapidly discharged and eliminated away from working area, so surface roughness of processed workpieces can be rapidly improved.

BRIEF DESCRIPTION OF THE DRAWINGS

Other objects, features, and advantages of the present invention will become apparent from the following detailed description of the preferred but non-limiting embodiment. The description is made with reference to the accompanying drawings in which.

DETAILED DESCRIPTION OF THE PREFERRED EMBODIMENT

Figure 1:
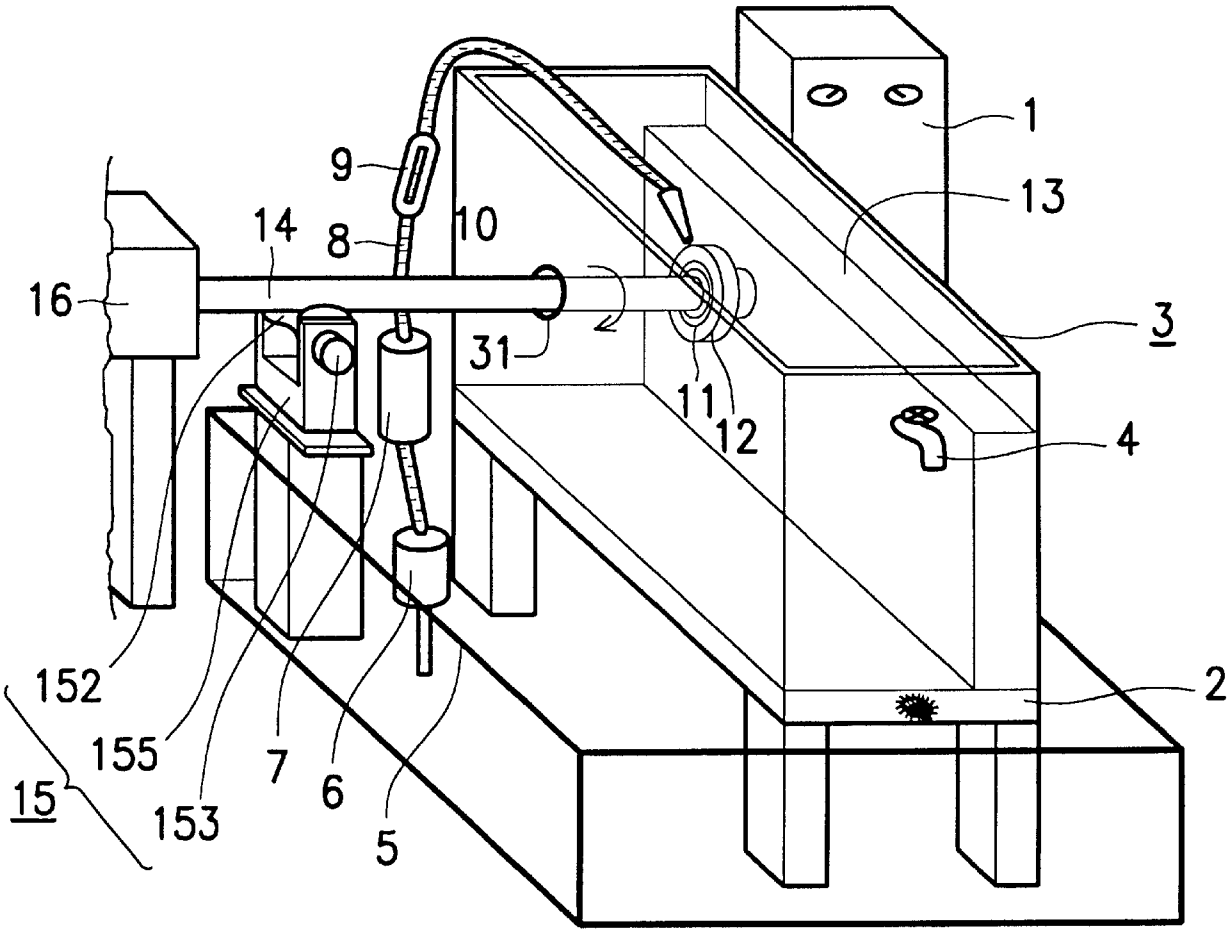
FIG. 1 is a perspective view of a conventional rod-forming machine tool retrofitted with an ultrasonic apparatus of the present invention.
Figure 2:
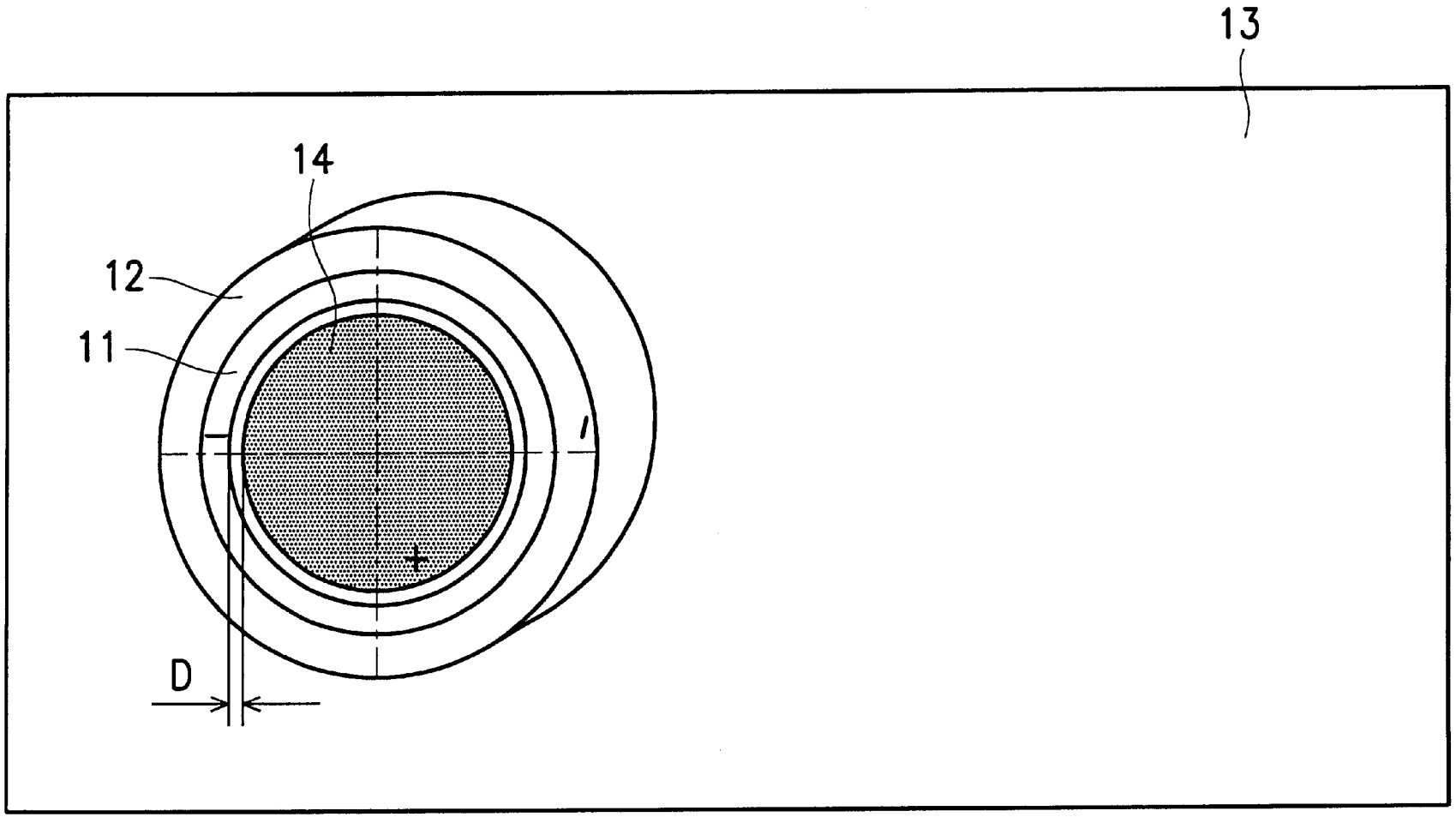
FIG. 2 shows a cross-sectional view of a tool electrode within a metal tube workpiece.

It is an object of the present invention to provide an electropolishing apparatus which is aided by ultrasonic means for rapid discharging and elimination of dregs and other electropolishing byproducts from working area, so surface roughness of processed workpieces can be rapidly improved. Furthermore, the ultrasonic means can be easily retrofitted to almost every existing machine tool as an auxiliary unit, or the ultrasonic means can be installed separately as an independent ultrasonic generating unit. Metal workpieces are immersed in an electrolyte solution excited by high-frequency ultrasonic energy in order to have the dregs and other electropolishing byproducts rapidly discharged and removed from the working area, so surface roughness of processed workpieces can be rapidly improved with a simple, low-cost ultrasonic apparatus. In particular, the electropolishing process is applicable to metal workpieces requiring further polishing after conventional or non-conventional machining steps such as those of milling and electro-erosion, respectively, for a low-cost, timesaving, and automation-oriented polishing process.

According to the present invention, shape-forming machine tools such as an electric discharge machining (EDM) device can be retrofitted with a minimum of an additional DC power source 1, an ultrasonic cleaning device 2, an electrolyte supplying tank 5, a pump 6, a filter 7, and at least one jet stream channel 8 to complete an ultrasonic apparatus. The positive terminal of the DC power source 1 is connected to the conductive shape-forming die 16 through which the workpiece is initially formed while the negative terminal is connected to a conductive chuck 12 of the electropolishing apparatus which holds a tool electrode 11. In practice, the ultrasonic apparatus of the present invention has proved to be a valuable tool for aiding conventional electropolishing processes.

The ultrasonic apparatus of the present invention can be conveniently installed to an existing machine tool while the existing machine tool still maintains all of its original intended functions. After a workpiece is preferably machined by a conventional or a non-conventional method, the ultrasonic apparatus of the present invention is activated by turning on the DC power source 1 for an ultrasonic-aided electropolishing process. For a cylindrical type workpiece 14 (i.e. tubes or rods) of 10 mm in diameter, the voltage is preferably set at 10~15V with a current of 5~15A, and an electrolyte of NaCl or $NaNO_3$ solution of 20%~40% concentration by weight. The tool electrode is then installed onto the electrode holding chuck 12, and the chuck 12 is further anchored on a supporting block 13, which altogether constitute a tool electrode holding device of the present invention.

Furthermore, a workpiece feeding device 15 for feeding the workpiece 14 into an ultrasonic cleaning device 2 comprises a roller 151, a motor 153, and a supporting bracket 155. After the workpiece 14 is initially formed by the shape-forming die 16, the motor 153 provides sufficient torque to drive the roller 151 into rotation for feeding the workpiece 14 into the workpiece receiving opening 31 at a preferred feeding rate of 1.5~2.5 mm/min while it is being supported by the supporting bracket 155. Specifically, the workpiece 14 enters the cleaning tank 3 of the ultrasonic cleaning device 2 from the workpiece receiving opening 31 and then gradually works its way into and through the tool electrode 11 for electropolishing.

Contained inside the electrolyte supplying tank 5 is an electrolyte solution of proper concentration for providing electrolyte to the ultrasonic cleaning device 2. In particular, the electrolyte is to be completely filled in space between the workpiece 14 and the tool electrode 11. Such electrode solution is preferably chosen to be either a Sodium Chloride (NaCl) or a Sodium Nitrate ($NaNO_3$) solution of 20%~40% concentration by weight. The electrolyte solution is drawn by a pump 6, filtered through by a filter 7, conveyed by way of a jet stream channel 8 until it reaches the flowmeter 9 for flow rate measuring, whereas the preferred flow rate is set at above 4 liter/min. Further, an electrolyte solution jet stream is delivered by a nozzle 10 of the jet stream channel 8 to create swirling current within the gap between the workpiece 14 and the tool electrode 11, whereas the preferred gap is set at 0.3 mm. As the electrolyte solution flows into the cleaning tank 3 of the ultrasonic cleaning device 2 and accumulates, a water relief valve 4 makes sure that the solution does not overflow by draining excessive solution out of the cleaning tank 3 and back into the electrolyte supplying tank 5. Accordingly, an electrolyte supplying device of the present invention is constituted by the electrolyte supplying tank 5, the pump 6, the filter 7, the flowmeter 9, and the nozzle 10 of the ultrasonic cleaning device 2, whereas the jet stream channel 8 connects all of the above components in series.

A tool electrode 11 is provided in the ultrasonic cleaning device 2 in order to carry out electropolishing before ultrasonic dregs discharge operation for both the tool electrode 11 and the workpiece 14 is turned on. In addition, the ultrasonic cleaning device 2 also comprises a cleaning tank 3 for holding the electrolyte solution coming from the electrolyte supplying device, an electrode holding chuck 12 installed on a vertical side wall of the supporting block 13 for gripping said tool electrode 11, and an ultrasonic generator provided in the cleaning tank 3 for generating high frequency ultrasonic vibrating energy.

As shown in FIG. 1, the ultrasonic cleaning device 2, besides having an internal ultrasonic generator, also comprises a cleaning tank 3 and a water relief valve 4. The cleaning tank 3 holds the electrolyte solution and operates similar to the functions of an electropolishing tank during an electropolishing process. As soon as the cleaning tank 3 is filled with the electrolyte solution, a power switch for the ultrasonic cleaning device 2 is turned on to activate and generate high frequency ultrasonic energy for cleaning. The water relief valve 4 then makes sure that the level of the electrolyte solution inside the cleaning tank 3 is not rising to the top brim of the tank 3.

It is another object of the present invention to have an ultrasonic apparatus retrofitted to an existing machine tool or to have the ultrasonic apparatus separately installed as an auxiliary ultrasonic generating unit. In both cases, it is a further object of the present invention to make the installation or retrofitting procedure as simple as the application allows. In essence, all types of conventional or non-conventional shape forming machine tools, according to the present invention, can be installed with a DC power source 1, an ultrasonic cleaning device 2, an electrolyte supplying tank 5, a pump 6, a filter 7, and at least one jet stream channel 8 in order to successfully operate as a complete ultrasonic apparatus. A positive terminal of the DC source is connected to a workpiece 14 that is to be polished while the negative terminal is connected to the tool electrode 11. During an electropolishing process, high-frequency vibrating ultrasonic energy is provided directly to the electrolyte to assist the electropolishing process throughout the entire course in order to effectively prevent reaction byproducts from attaching to the electrode.

The followings are elaborated steps of an electropolishing process for a cylindrical type workpiece of a rod or a tube configuration aided by ultrasonic dregs discharge according to the present invention Step 1: Connect the positive terminal of the DC power source 1 to the conductive shape-forming die 16 through which the workpiece is formed, and connect the negative terminal to the conductive chuck 12 of an electropolishing apparatus which holds a tool electrode 11.

Step 2: Select the best operating modes of the DC power source 1 by adjusting voltage, current, and pulsing rate etc, whereas the preferred voltage is set at 10~15V, current at 5~15A, and pulsing rate at a fraction of a second per cycle.

Step 3: Choose appropriate tool electrode shapes and sizes with considerations that the preferred gap between the tool electrode 11 and said workpiece is between 0.2 and 1.0 mm, whereas the best mode requires the gap to be at least 0.3 mm.

Step 4: The tool electrode is then installed onto the electrode holding chuck 12. A workpiece feeding device for feeding the workpiece to be electropolished by the tool electrode at a preferred feeding rate of 1.5~2.5 mm/min is provided.

Step 5: Prepare a suitable Sodium Chloride (NaCl) or Sodium Nitrate ($NaNO_3$) based electrolyte solution of 20%~40% concentration by weight, which is to be filled in the electrolyte supplying tank 5 and stirred for uniformity. In addition, the electrolyte solution should flood over the top of the workpiece 14, and a nozzle 10 is to deliver an electrolyte solution jet stream passing through the gap between the workpiece 14 and the tool electrode 11 for maximum dregs cleaning effect.

Step 6: Adjust water relief valve 4 of the cleaning tank 3, which is a part of the ultrasonic cleaning device 2, for keeping the electrolyte solution level in the cleaning tank 3 balanced during an electropolishing process. The electrolyte solution flowing out of the water relief valve 4 is drained to the electrolyte supplying tank 5 where it is to be drawn by a pump 6, filtered through by a filter 7, measured by a flowmeter 9, then finally ejaculated by the nozzle 10 of a jet stream channel 8. The preferred flow rate is set at above 4 Liter/min.

Step 7: Adjust the motor 153 of the workpiece feeding device 15 until a preferred feeding rate of about a few millimeters per minute is reached, whereas the best mode is set at 1.5~2.5 mm/min.

Step 8: Switch on the DC power supply 1 and the pump 6 in the electrolyte supplying tank 5, so the electrolyte solution can be filled into the cleaning tank 3 of the ultrasonic cleaning device 2. Moreover, the electrolyte solution is to be kept at a level high enough so that the entire workpiece 14 is submerged before the power of the ultrasonic cleaning device 2 is turned on.

Step 9: Switch on a shape-forming apparatus, whereas an unrefined workpiece of a rod or a tube configuration is formed by passing through the shape-forming die 16 of the electropolishing apparatus. While it is being supported by the roller 151 and the supporting bracket 155 of the workpiece feeding device 15, the workpiece 14 enters the cleaning tank 3 of the ultrasonic cleaning device 2, at a fixed feeding rate, from the workpiece receiving opening 31 and then proceeds to the tool electrode 11 for electropolishing.

Figure 3:
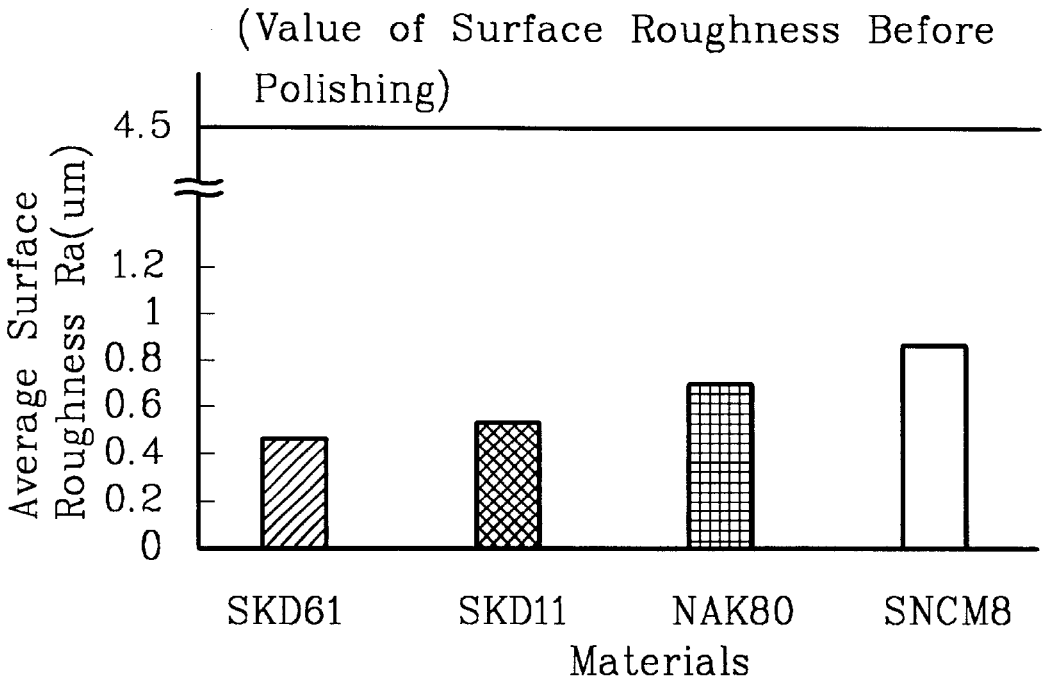
FIG. 3 is a bar graph depicting relative average surface roughness Ra of certain metallic workpieces polished by various electrode materials.
Figure 4:
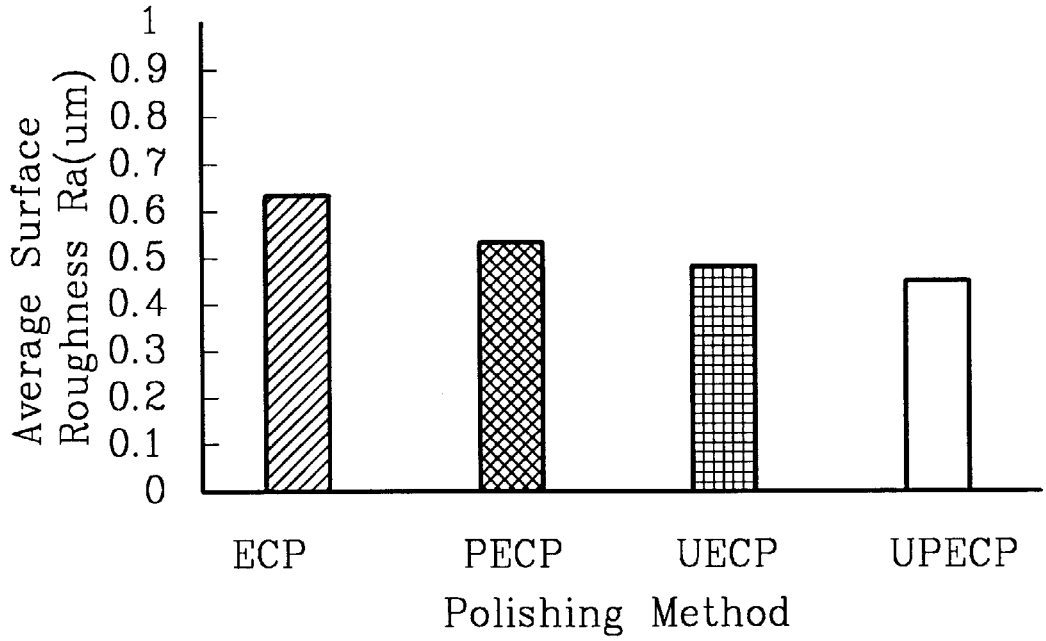
FIG. 4 is a bar graph depicting relative average surface roughness Ra of certain metallic workpieces polished by various conventional and non-conventional methods.

By subjecting several different workpiece materials to a certain shape and type of tool electrode for electropolishing aided by an ultrasonic dregs discharge apparatus of the present invention, it has been proven, as shown in FIG. 3, wherein the operating conditions were $NaNO_3$, 25% Wt, 4 Liter/min, Continuous DC, 10A, 12V, 2 mm/min, the average surface roughness of a workpiece can be rapidly improved. FIG. 4 shows a chart comparing the polishing effect done by various conventional and non-conventional methods including the electrochemical polishing, pulsing electrochemical polishing, ultrasonic electrochemical polishing, and ultrasonic pulsing electrochemical polishing, wherein the operating conditions were: SKD 61, $NaNO_3$, 25% Wt, 4 Liter/min, Continuous DC, 10A, 12V, 2 mm/min. This figure proves that ultrasonic dregs cleaning can further improve the conventional electropolishing technology with results matching or surpassing at least that of the pulsing electrochemical polishing process at a low cost.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An electropolishing apparatus aided by ultrasonic energy for rapidly improving surface roughness of a metal workpiece, comprising:

an electrolyte supplying device for providing electrolyte solution;

an ultrasonic cleaning device receiving the electrolyte solution from the electrolyte supplying device comprising:

a cleaning tank for holding the electrolyte solution coming from the electrolyte supplying device, a tool electrode provided in the ultrasonic cleaning device for an electropolishing operation, an electrode holding chuck for gripping the tool electrode, and an ultrasonic generator provided in the cleaning tank for generating high frequency ultrasonic vibrating energy; and a feeding device for feeding the metal workpiece into the ultrasonic cleaning device;

wherein the metal workpiece is fed into the electrolyte solution and electropolished by the tool electrode while simultaneously being cleaned by the ultrasonic cleaning device.

2. The electropolishing apparatus as claimed in claim 1, further comprising a DC power source such that the positive terminal of the DC source is connected to the workpiece and the negative terminal connected to the tool electrode.

3. The electropolishing apparatus as claimed in claim 2, wherein the DC power source is set to a voltage of 10~15V with a current of 5~15A.

4. The electropolishing apparatus as claimed in claim 1, wherein the ultrasonic cleaning device further comprises a water relief valve installed on the cleaning tank for preventing overflow.

5. The electropolishing apparatus as claimed in claim 1, wherein the electrolyte supplying device comprises:

an electrolyte supplying tank;

a pump;

a filter connected to the pump;

a flowmeter for me flow rate; and a nozzle;

wherein the pump pumps electrolyte solution from the supply tank through the filter and flowmeter to the nozzle, for delivering an electrolyte solution jet stream to a gap between the workpiece and the tool electrode.

6. The electropolishing apparatus as claimed in claim 5, wherein the electrolyte- supplying tank, pump, filter, flowmeter, and nozzle are all connected by a jet stream channel.

7. The electropolishing apparatus as claimed in claim 1, wherein the feeding device comprises:

a supporting bracket;

a roller;

a motor;

wherein, the motor provides sufficient torque to drive the roller into rotation for feeding the workpiece into the electrolyte solution while it is being supported by the supporting bracket.

8. The electropolishing apparatus as claimed in claim 1, wherein the electrolyte supplying device provides the electrolyte solution which comprises a Sodium Chloride (NaCl) or Sodium Nitrate ($NaNO_3$) based electrolyte solution of 20%~40% concentration by weight.

9. The electropolishing apparatus as claimed in claim 1, wherein the feeding device is configured to operate at a feeding rate of 1.5~2.5 mm/min.

10. A method of electropolishing aided by an ultrasonic means for rapidly improving surface roughness of a metallic workpiece, comprising:

providing a metal workpiece;

providing a cleaning tank;

providing a tool electrode in the cleaning tank;

connecting a first terminal of a DC power source to a conductive shape-forming die through which the metal workpiece is initially formed and connecting a second terminal of the DC power source to an electrode holding chuck for gripping the tool electrode;

preparing a suitable electrolyte solution in the cleaning tank, such that the tool electrode is submerged in the electrolyte solution;

feeding the metal workpiece into the cleaning tank, such that the metal workpiece is submerged in electrolyte solution;

electropolishing the surface of the metal workpiece by switching on the DC power source; and cleaning the metal workpiece with an ultrasonic cleaning device at the same time the electropolishing is performed.

11. The method as claimed in claim 10, wherein the step of providing a metal workpiece comprises forming the metal workpiece with a conductive shape-forming die.

12. The method as claimed in claim 10, wherein the best operating modes of the DC power source are selected by adjusting voltage, current, and pulsing rate etc.

13. The method as claimed in claim 10, wherein a gap formed between the tool electrode and the workpiece is between 0.2 and 1.0 mm.

14. The method as claimed in claim 10, wherein preparing a suitable electrolyte solution includes providing the electrolyte solution which comprises a Sodium Chloride (NaCl) or Sodium Nitrate ($NaNO_3$) based electrolyte solution of 20%~40% concentration by weight.

15. The method as claimed in claim 10, wherein the DC power source is set to a voltage of 10~15V with a current of 5~15A for the metal workpiece having a cylindrical shape being 10 mm in diameter.

16. The method as claimed in claim 10, wherein the feeding comprises operating at a feeding rate of 1.5~2.5 mm/min.

* * * * *